United States Patent [19]

Kuhn

[11] Patent Number: 4,522,677

[45] Date of Patent: Jun. 11, 1985

[54] FELLER ATTACHMENT FOR A HEAT-SEALING MACHINE FOR BELTS

[75] Inventor: Elmar Kuhn, Wuppertal, Fed. Rep. of Germany

[73] Assignee: Astor-Werk, Otto Berning & Co., Fed. Rep. of Germany

[21] Appl. No.: 597,723

[22] Filed: Apr. 6, 1984

[51] Int. Cl.[3] ..... B31F 1/00

[52] U.S. Cl. ..... 156/467; 156/461

[58] Field of Search ..... 156/461, 467

[56] References Cited

U.S. PATENT DOCUMENTS

| | | | |
|---|---|---|---|
| 3,655,478 | 4/1972 | Gerschwender | 156/461 X |
| 3,880,697 | 4/1975 | Off et al. | 156/467 |
| 4,432,831 | 2/1984 | Blicher | 156/467 |

*Primary Examiner*—J. Howard Flint, Jr.

*Attorney, Agent, or Firm*—Jones & Askew

[57] ABSTRACT

Feller attachment for a heat-sealing machine for belts, with a feller plate (10), with feller gibs on the feller plate, these feller gibs (20, 21) being arranged at a certain distance from each other and extending in the direction of feed and serving to fell a cover material around the interlining of a belt, with a feeding device (51, 52) for a belt cover band, and a comb (40) for stretching and smoothing the cover material over the interlining prior to applying the belt cover band, with an adjusting device for adjusting the distance of the ends (60, 61) of the feller gibs (20, 21) to each other, this adjusting device meshing with the ends (60, 61) of the feller gibs (20, 21) with these ends pointing toward the heat-sealing machine for belts, and consisting of a sliding bar (44) with sliding bearings (41, 42) arranged thereon and a threaded spindle (46) which meshes with tapped holes (62, 63) in the sliding bearings (41, 42), with the threads (64, 65) on both ends of the threaded spindle (46) as well as the tapped holes (62, 63) in the sliding bearings (41,42) exhibiting opposite thread pitches, and guides (37, 38) which are arranged on the lower end (66, 67) of each sliding bearing (41, 42), this guide having recesses (68, 69) which hold the projections (70, 71) on each end (60, 61) of the feller gibs (20, 21), with the ends (72, 73) of the feller gibs (20, 21) being guided in slotted holes (74, 75) which extend at right angles to the direction of feed. In addition, an adjusting device for the guide pieces (51, 52) of the belt cover band as well as an adjusting device for the comb (40) are provided.

7 Claims, 3 Drawing Figures

FELLER ATTACHMENT FOR A HEAT-SEALING MACHINE FOR BELTS

The subject of this invention is a feller attachment for a heat-sealing machine for belts, with a feller plate, with feller gibs on the feller plate, these feller gibs being arranged at a certain distance from each other and extending in the direction of feed and serving to fell a cover material around the backing of a belt, with a guide for introducing a belt cover band, and a comb for stretching and smoothing the cover material over the interlining prior to applying the belt cover band.

Heat-sealing machines for belts serve to produce belts which consist of an interlining, a cover material around the interlining, and a belt cover band. This interlining consists of a solid material, e.g., plastic. The cover material consists of a textile material and the belt cover band consists of a textile or a plastic material. In order to manufacture a belt, the interlining is cut into the shape desired and is placed on the cover material which also has been cut to fit the shape of the belt. Subsequently, the cover material is felled around the interlining amd the belt cover band is arranged on the felled surfaces of the cover material. This arrangement is conveyed to the heat-sealing machine for belts by means of appropriate conveying devices; in the heat-sealing machine, the interlining, the cover material, and the belt cover band are bonded together through the action of heat and pressure in order to heat-set the individual parts. If desired, the parts can subsequently be sewn together as well.

One well-known feller attachment is designed in such a way that, for the purpose of felling the cover material around the interlining, it has a feller plate on which the feller gibs are rigidly arranged on both sides of the interlining, with each of the feller gibs exhibiting an interior surface which fells the cover material on the interlining. The cut interlining is arranged on the cut cover material and is inserted from the feeding end so that it is aligned between the feller gibs. Between the feller gibs, the interlining and the cover material are held in place by means of a retaining spring. After felling the cover material, pressure is exerted from above onto the arrangement consisting of interlining and felled cover material, this pressure being applied by means of a pressure roll for the purpose of holding the arrangement together. A conveyor belt which is located below the arrangement conveys the arrangement through a comb in which the cover material is tightly stretched around the interlining. By means of a guiding device, the cover band is laid onto the arrangement, and the arrangement together with the cover band is fed into the heat-sealing machine for belts.

So far, only complete feller attachments are available which have to be exchanged every time the width of the belt to be manufactured changes. As a result of the great number of feller attachments required, the expense is great indeed.

It is therefore the objective of this invention to develop a feller attachment of the type mentioned earlier in such a way that the change-over time of the feller attachment is reduced and the adjustment of the feller attachment is simplified.

This objective is met by means of a feller attachment for a heat-sealing machine, with a feller plate, with feller gibs on the feller plate, these feller gibs being arranged at a certain distance from each other and extending in the direction of feed and serving to fell a cover material around the interlining of a belt, with a guiding device for introducing a belt cover band, and a comb for stretching and smoothing the cover over the interlining prior to applying the belt cover band, characterized by an adjusting device for adjusting the distance of the ends of the feller gibs to each other, this adjusting device meshing with the ends of the feller gibs, with these ends pointing toward the heat-sealing machine for belts, and consisting of a sliding bar with sliding bearings arranged thereon and a threaded spindle which meshes with tapped holes in the sliding bearings, with the threads on both ends of the threaded spindle as well as the tapped holes in the sliding bearings exhibiting opposite thread pitches, and a guide which is arranged on the lower end of each sliding bearing, this guide having recesses which hold the projections on each end of the feller gibs, with the ends of the feller gibs being guided in slotted holes which extend at right angles to the direction of feed, an adjusting device for the guide pieces for the belt cover band, developed from the subordinate claims.

As a result of the fact that the adjusting device for the guide pieces for the belt cover band consists of a sliding bar and a threaded spindle with threads which are arranged on both ends of the threaded spindle and which exhibit opposite thread pitches, with the guide pieces being guided on the sliding bar in borings in such a way that the guide pieces can slide back and forth, and with the threads of the threaded spindle meshing with the corresponding tapped holes in the guide pieces, a possibility for adjusting the guides for the belt cover band is provided, which is of great advantage.

The embodiment of this invention according to which the sliding bar and the threaded spindle for the feller gibs as well as the sliding bar and the threaded spindle for the guide pieces for the belt cover band are carried on one side in a pedestal bearing which is connected with the frame of the machine and on the other side in a column of the machine frame, ensures a compact arrangement of the adjusting device.

As a result of the fact that the adjusting device for the comb comprises a pressure piece which is arranged on the sliding bar for the feller gibs and which has a tapped hole, this tapped hole being arranged in one surface of the pressure piece which faces away from the sliding bar and which extends parallel to a conveyor belt of the heat-sealing machine for belts and having an attachment screw which fits into and meshes with an indentation on the upper surface of the comb, an extremely simple possibility for adjusting the comb is ensured.

As a result of the arrangement of grooves on the lower surface of the comb, which converge in the direction of the heat-sealing machine, and as a result of the arrangement of a pressure roll on the ends of the feller gibs and a retaining spring which is arranged on the entrance end of the feller gib, it is ensured that the interlining and the cover material are accurately fed into the heat-sealing machine for belts.

One practical example of this invention is shown in the drawing and will be described in greater detail below. It can be seen that:

Figure 1:
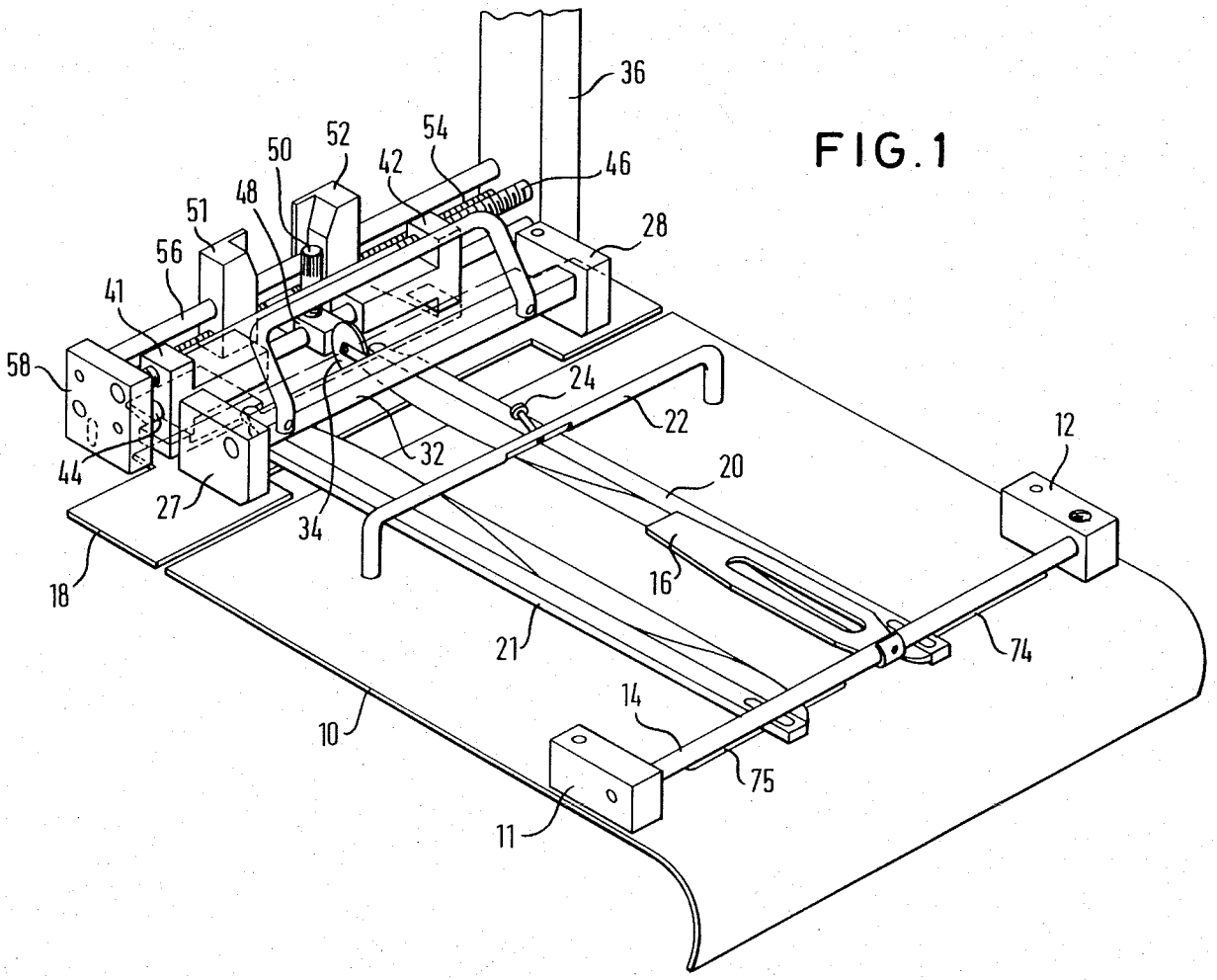
FIG. 1 shows a perspective view of the feller device.
Figures 2, 3:
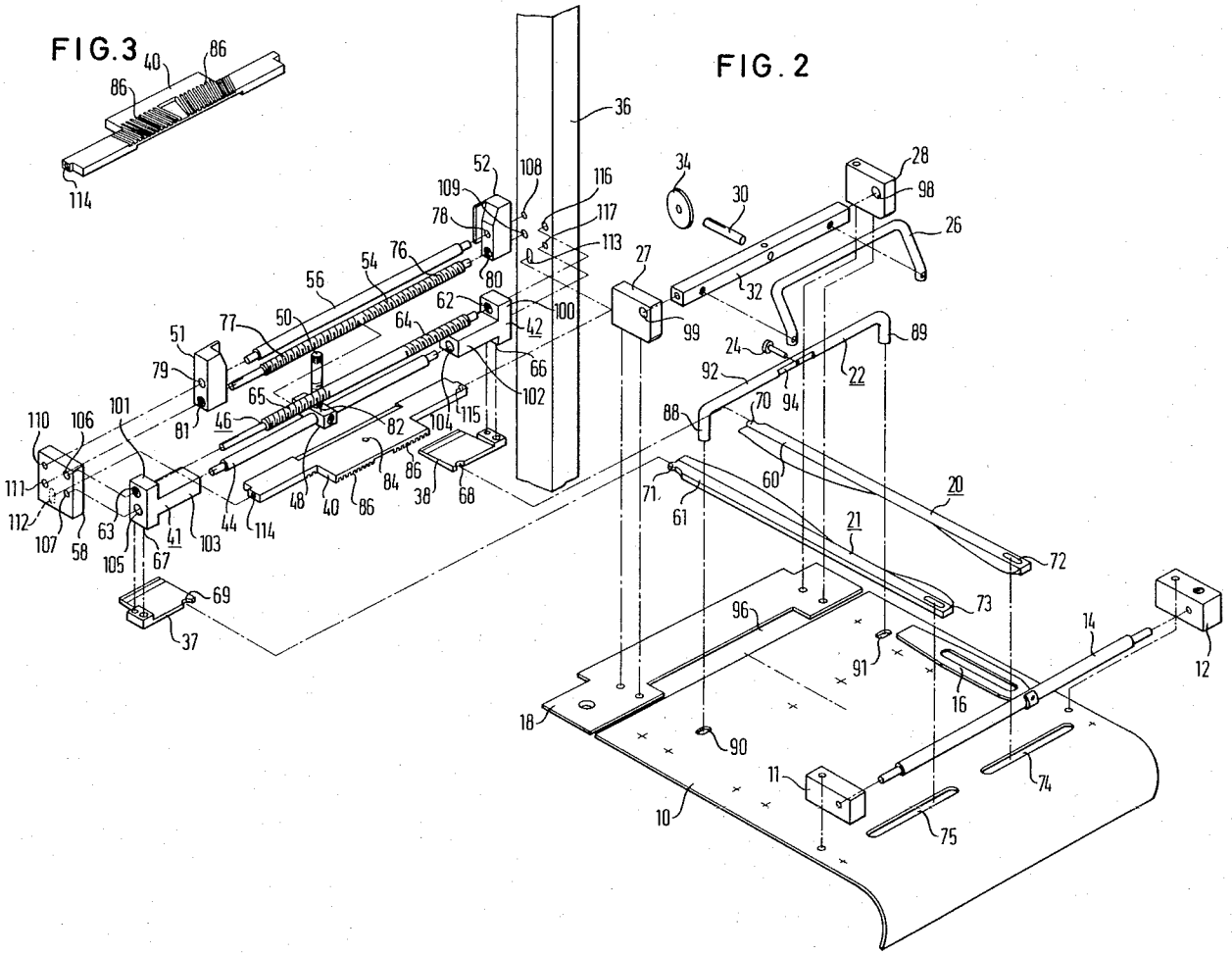
FIG. 2 shows an exploded view of the feller device.
FIG. 3 shows a view of the comb from below.

The feller device shown in the drawing consists of a rectangular feller plate 10 which curves downward along the edge of its feeding end. Beginning at the feeding end, two feller gibs 20, 21 which are arranged at a certain distance from each other and which converge extend toward the back end of the feller plate 10. On the feeding end, the feller gibs 20, 21 are guided in slotted holes 74, 75 which run at right angles to them and which are cut into the feller plate 10. Also along the feeding end of the feller plate 10, pedestal bearings 11, 12 for a retaining spring pole 14 are arranged on both lateral edges, with a retaining spring plate 16 being attached to the retaining spring pole 14. The retaining spring plate 16 fills the space between the feller gibs 20, 21 and exerts pressure onto the inserted interlining with the cover material. The force of the pressure can be adjusted with the retaining spring pole 14 by means of turning and setting the pole 14 in the pedestal bearings 11.

The pedestal bearings 11, 12 are attached onto the feller plate 10 by means of screws or any other suitable fastening devices.

In the back area of the feller plate 10, a rectangular bracket 22 is arranged, which extends over the feller gibs 20, 21. The legs 88, 89 of the bracket 22 which is generally U-shaped are screwed or fastened in any other suitable way to the feller gib 10. In the practical example shown in the illustration, screws are screwed into the ends of the bracket legs, with these screws extending through appropriate borings 90, 91 from the lower surface of the feller gib 10. In its center, the bridge 92 of the bracket 22 has a recess 94. The recess 94 has a depth of approximately half of the thickness of the bracket. The bottom of the recess 94 is level. In the center of the bottom, a boring is provided, into which a spring-loaded bolt is inserted, with a helical spring which encompasses the bolt shank being arranged on the side of the bracket 22, which is opposite to the bottom (not shown), and supporting itself against the bolt knob and the bracket 22 in order to prestress the bolt 24.

The bracket 22 serves to hold the feller spring which is generally known (not shown). The feller spring is held and prestressed by means of knob 24. The feller spring serves to restrain the interlining of the belt to be felled.

Abutting on the end of the feller plate 10 is a cover plate 18 with a rectangular recess 96 in the shape of a U, which points to the feller plate 10. This recess 96, along with the end edge of the feller plate 10, forms an opening for the passage of a conveyor belt (not shown) which moves into the heat-sealing machine for belts. The ends 60, 61 of the feller gibs 20, 21 extend beyond the feller plate 10 into the area of the cover plate 18.

On both sides of the U-shaped recess 96, parallel to its legs, pillow blocks 27, 28 are arranged. The pillow blocks 27, 28 have borings 98, 99 for holding a shaft 32. In the direction of feed, a bearing yoke 30 which holds a pressure roll 34 on its end which faces away from the shaft 32, is attached to the swivelling shaft 32. The pressure roll 34 can be swivelled in the direction of the conveyor belt by means of the swivelling shaft 31.

The ends 60, 61 of the feller gibs 20, 21, these ends being located in the area of the cover plate 18, exhibit projections 70, 71 which fit into the recesses 68, 69 which are cut into the guides 37, 38. The guides 37, 38 are arranged below a comb 40—which will be described below—and can be moved relative to the comb 40 at right angles to the direction of the belt conveyor by means of sliding bearings 41, 42. The sliding bearings 41, 42 generally are T-shaped. The transversal bar 100, 101 of the T-shaped sliding bearing 41, 42 is in vertical position and is connected with the guide 37, 38 by means of screws or other suitable fastening devices. The section 102, 103 which extends at a right angle from the transversal bar 100, 101 has a straight-through boring 104, 105 which carries a sliding bar 44. In the space which extends between the guide 37, 38 and the rectangular section 102, 103 of the T-shaped sliding bearing 41, 42, the front part of the comb 40 which will be described below is located.

The upper section of the transversal bar 100, 101 of the T-shaped sliding bearing 41, 42 has a tapped hole 62, 63 which meshes with a threaded spindle 46 which is arranged above the sliding bar 44. A turning knob which is located outside the T-shaped sliding bearing 42 and which is connected to the threaded spindle 46 serves to turn the threaded spindle 46. By means of turning the threaded spindle 46, the sliding bearings 41, 42 on both sides are moved toward or away from each other along the sliding bar 44 due to the opposite threads 64, 65 which are to be found on both sides of the threaded spindle 46. As a result of this, the guides 37, 38 which are connected with the T-shaped sliding bearings 41, 42 and the ends 60, 61—whose projections fit into the recesses of these guides 37, 38—of the feller gibs 20, 21 move such that the distance of the ends 60, 61 of the feller gibs 20, 21 can be changed. In order to determine the distance of the feller gibs 20, 21, a suitable scale can be attached onto the turning knob.

The sliding bar 44 and the threaded spindle 46 are held on one side in borings 104, 105 in a column 36 of the machine frame and on the other side in the same way in borings 106, 107 in the pedestal bearing 58.

For the purpose of holding a second sliding bar and threaded spindle arrangement which is to be positioned behind the first sliding bar and threaded spindle arrangement, further borings 108, 109; 110, 111 are provided in the pedestal bearing 58 and in the column 36. On the second sliding bar 56, guide pieces 51, 52 for the belt cover band, which can be moved by means of turning the threaded spindle 54, are arranged at a right angle to the belt feeding direction. The threaded spindle 54 exhibits a turning knob (not shown) which is positioned outside the pedestal bearing 58. The lower surface of the pedestal bearing 58 is fastened to the machine frame.

In the pedestal bearing 58 and in the column 36, below the borings for the sliding bar and threaded spindle arrangement, vertically arranged slotted holes 112, 113 are provided for the purpose of holding the comb 40 mentioned earlier.

The comb 40 is essentially designed in the shape of a T, with both ends of the transversal bar exhibiting borings 114, 115 which are aligned with the slotted holes 112, 113 for the purpose of holding the comb. Suitable pins (not shown) are used to attach the comb 40 onto the pedestal bearing 58 and the column 56.

On its lower surface, the comb 40 exhibits grooves 86 which converge towards its back edge. On the upper surface, it has an indentation 84 which can receive a pressure screw 50 which exerts a certain pressure onto the comb 40 by means of a pressure device which will be described below, such that the distance of the comb to the conveyor belt can be adjusted depending on the thickness of the material to be processed.

The pressure device is positioned on the first sliding bar 44 and consists of a pressure piece 48 which is attached to the sliding bar 44, with this pressure piece running parallel to and at a certain distance from the upper surface of the comb. In the part which runs at a certain distance from the upper surface of the comb, a vertical tapped hole 82 is provided, into which a pressure screw 50 is fitted. The pressure screw 50 fits with its lower end into the indentation 84 of the upper surface of the comb and can thus change the distance between the comb and the conveyor belt as well as the pressure exerted onto the comb 40.

The converging 86 which run along the lower surface of the comb 40 serve to smooth and stretch the cover material over the interlining before the belt cover band is attached thereon.

The feller attachment operates in the following way:

First, the distance of the feller gib ends 60, 61 to each other is adjusted as a function of the width of the belt to be manufactured, by means of the first sliding bar and threaded spindle arrangement. Subsequently, the distance of the guides of the belt cover band to each other is set as a function of the width of the belt cover band used. Then, the feller gib ends 72, 73 are fastened into the slotted holes 74, 75 on the feeding end of the feller plate 10 in such a way that an appropriate feeding of cover material and interlining is ensured. Subsequently, the distance of the comb 40 from the conveyor belt is set by means of the pressure screw 50 in such a way that the cover material is positioned without wrinkles and smoothly above the interlining before the belt cover band is applied thereon and the layering consisting of interlining, cover material, and belt cover band is fed into the heat-sealing machine for belts for the purpose of fusing them together.

In order to ensure a good contact between cover material and interlining with the conveyor belt prior to feeding them into the comb 40, a certain pressure is exerted onto the interlining by means of the pressure roll 34 by activating the clamp strap 26.

The feller attachment described in this invention makes it possible to quickly adjust the varying belt widths and/or belt materials, which increases the productivity considerably.

I claim:

1. Feller attachment for a heat-sealing machine for belts, with a feller plate, with feller gibs on the feller plate, these feller gibs being arranged at a certain distance from each other and extending in the direction of feed and serving to fell a cover material around the interlining of a belt, with a feeding device for feeding a belt cover band, and a comb for stretching and smoothing the cover material over the interlining prior to applying the belt cover band, characterized by an adjusting device for adjusting the distance of the ends (60, 61) of the feller gibs (20, 21) to each other, this adjusting device meshing with the ends (60, 61) of the feller gibs (20, 21), with these ends pointing toward the heat-sealing machine for belts, and consisting of a sliding bar (44) with sliding bearings (41, 42) arranged thereon and a threaded spindle (46) which meshes with tapped holes (62, 63) in the sliding bearings (41, 42), with the threads (64, 65) on both ends of the threaded spindle (46) as well as the tapped holes (64, 63) in the sliding bearings (41, 42) exhibiting opposite thread pitches, and guides (37, 38) which are arranged on the lower end (66, 67) of each sliding bearing (41, 42), this guide having recesses (68, 69) which hold the projections (70, 71) on each end (60, 61) of the feller gibs (20, 21), with the ends (72, 73) of the feller gibs (20, 21) being guided in slotted holes (74, 75) which extend at right angles to the direction of feed, an adjusting device for the guide pieces (51, 52) for the belt cover band, and an adjusting device for the comb (40).

2. Feller attachment according to claim 1, characterized by the fact that the adjusting device for the guide pieces (51, 52) for the belt cover band consists of a sliding bar (56) and a threaded spindle (54) with threads (76, 77) which are arranged on both ends of the threaded spindle and which exhibit opposite thread pitches, with the guide pieces (51, 52) being guided on the sliding bar (56) in borings (78, 79) in such a way that the guide pieces can slide back and forth, and with the threads (76, 77) of the threaded spindle (54) meshing with the corresponding tapped holes (80, 81) in the guide pieces (51, 52).

3. Feller attachment according to claim 1 or 2, characterized by the fact that the sliding bar (44) and the threaded spindle (46) for the feller gibs (20, 21) as well as the sliding bar (56) and the threaded spindle (54) for the guide pieces (51, 52) for the belt cover band are carried on one side in a pedestal bearing (58) which is connected with the frame of the machine and on the other side in a column (36) of the machine frame.

4. Feller attachment according to claim 1, characterized by the fact that the adjusting device for the comb (40) comprises a pressure piece (48) which is arranged on the sliding bar (44) for the feller gibs (20, 21) and which has a tapped hole (82), this tapped hole being arranged in one surface of the pressure piece (48) which faces away from the sliding bar (44) and which extends parallel to a conveyor belt of the heat-sealing machine for belts and having a pressure screw (50) which fits into and meshes with an indentation (84) on the upper surface of the comb (40).

5. Feller attachment according to claim 1, characterized by the fact that the comb (40) has on its lower surface grooves (86) which converge in the direction of the heat-sealing machine for belts.

6. Feller attachment according to claim 1, characterized by the fact that on the ends of the feller gibs (20, 21) a pressure roll (34) is provided, which can be brought into contact with the belt.

7. Feller attachment according to claim 1, characterized by the fact that a retaining spring (14, 16) is arranged between the feller gibs (20, 21) on the entrance end of the feller plate (10).

* * * * *